US007130795B2

(12) United States Patent
Gao

(10) Patent No.: US 7,130,795 B2
(45) Date of Patent: Oct. 31, 2006

(54) MUSIC DETECTION WITH LOW-COMPLEXITY PITCH CORRELATION ALGORITHM

(75) Inventor: Yang Gao, Mission Viejo, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 0 days.

(21) Appl. No.: 11/156,874

(22) Filed: Jun. 17, 2005

(65) Prior Publication Data

US 2006/0015327 A1 Jan. 19, 2006

Related U.S. Application Data

(63) Continuation-in-part of application No. 11/084,392, filed on Mar. 17, 2005, which is a continuation-in-part of application No. 10/981,022, filed on Nov. 4, 2004.

(60) Provisional application No. 60/588,445, filed on Jul. 16, 2004.

(51) Int. Cl.
*G10L 11/04* (2006.01)

(52) U.S. Cl. ..... 704/216

(58) Field of Classification Search ..... None
See application file for complete search history.

(56) References Cited

U.S. PATENT DOCUMENTS

2002/0161576 A1* 10/2002 Benyassine et al. ..... 704/229

OTHER PUBLICATIONS

Zhu et al.; Music Key Detection for Musical Audio; Procedings of the 11 th International Multimedia Modeling Conference 2005; pp. 30-37.*

* cited by examiner

*Primary Examiner*—Abul K. Azad
(74) *Attorney, Agent, or Firm*—Farjami & Farjami LLP

(57) ABSTRACT

A method is provided for detecting music in a speech signal having a plurality of frames. The method comprises obtaining one or more first pitch correlation candidates from a first frame of the plurality of frames; obtaining one or more second pitch correlation candidates from a second frame of the plurality of frames; selecting a pitch correlation (Rp) from the one or more first pitch correlation candidates and the one or more second pitch correlation candidates; and distinguishing music from background noise based on analyzing the pitch correlation (Rp). The method may further comprise filtering the speech signal using a one-order low-pass filter prior to the obtaining the one or more first pitch correlation candidates, and down sampling the speech signal by four prior to the obtaining the one or more first pitch correlation candidates

18 Claims, 10 Drawing Sheets

MUSIC DETECTION WITH LOW-COMPLEXITY PITCH CORRELATION ALGORITHM

RELATED APPLICATIONS

The present application is a Continuation-In-Part of U.S. patent application Ser. No. 11/084,392, filed Mar. 17, 2005, which is a Continuation-In-Part of U.S. patent application Ser. No. 10/981,022, filed Nov. 4, 2004, which claims priority to U.S. Provisional Application Ser. No. 60/588,445, filed Jul. 16, 2004, which are hereby incorporated by reference in their entirety.

APPENDIX

An appendix is included comprising an example computer program listing according to one embodiment of the present invention.

BACKGROUND OF THE INVENTION

1. Field of the Invention

The present invention relates generally to music detection. More particularly, the present invention relates to low-complexity pitch correlation calculation for use in music detection.

2. Background Art

In various speech coding systems it is useful to be able to detect the presence or absence of music, in addition to detecting voice and background noise. For example a music signal can be coded in a manner different from voice or background noise signals.

Speech coding schemes of the past and present often operate on data transmission media having limited available bandwidth. These conventional systems commonly seek to minimize data transmission while simultaneously maintaining a high perceptual quality of speech signals. Conventional speech coding methods do not address the problems associated with efficiently generating a high perceptual quality for speech signals having a substantially music-like signal. In other words, existing music detection algorithms are typically either overly complex and consume an undesirable amount of processing power, or are poor in ability to accurately classify music signals.

Further, conventional speech coding systems often employ voice activity detectors ("VADs") that examine a speech signal and differentiate between voice and background noise. However, conventional VADs often cannot differentiate music from background noise. As is known in the art, background noise signals are typically fairly stable as compared to voice signals. The frequency spectrum of voice signals (or unvoiced signals) changes rapidly. In contrast to voice signals, background noise signals exhibit the same or similar frequency for a relatively long period of time, and therefore exhibit heightened stability. Therefore, in conventional approaches, differentiating between voice signals and background noise signals is fairly simple and is based on signal stability. Unfortunately, music signals are also typically relatively stable for a number of frames (e.g. several hundred frames). For this reason, conventional VADs often fail to differentiate between background noise signals and music signals, and exhibit rapidly fluctuating outputs for music signals.

If a conventional VAD considers a speech signal not to represent voice, the conventional system will often simply classify the speech signal as background noise and employ low bit rate encoding. However, the speech signal may in fact comprise music and not background noise. Employing low bit rate encoding to encode a music signal can result in a low perceptual quality of the speech signal, or in this case, poor quality music.

Although previous attempts have been made to detect music and differentiate music from voice and background noise, these attempts have often proven to be inefficient, requiring complex algorithms and consuming a vast amount of processing resources and time.

Furthermore, although some music detection systems have reduced complexity and processing bandwidth by utilizing certain parameters that have already been calculated by the speech coding components, such as pitch gain, pitch correlation, energy, LPC gain, etc., in standalone music detection systems, such parameters are not available. Therefore, standalone music detection systems must perform complex and time consuming operations to derive such parameters in order to distinguish music from background noise Thus, it is seen that there is need in the art for an improved algorithm and system for differentiating music from background noise with high accuracy but relatively low-complexity to perform music detection using minimal processing time and resources.

SUMMARY OF THE INVENTION

The present invention is directed to a low-complexity music detection algorithm and system. The invention overcomes the need in the art for need in the art for an improved algorithm and system for differentiating music from background noise with high accuracy but relatively low-complexity to perform music detection using minimal processing time and resources.

According to one aspect of the present invention, a method is provided for detecting music in a speech signal having a plurality of frames. The method comprises obtaining one or more first pitch correlation candidates from a first frame of the plurality of frames; obtaining one or more second pitch correlation candidates from a second frame of the plurality of frames; selecting a pitch correlation (Rp) from the one or more first pitch correlation candidates and the one or more second pitch correlation candidates; defining a music threshold value for the pitch correlation (Rp); defining a background noise threshold value for the pitch correlation (Rp); defining an unsure threshold value for the pitch correlation (Rp), wherein the unsure threshold value falls between the music threshold value and the background noise threshold value. If the pitch correlation (Rp) does not fall between the music threshold value and the background noise threshold value, classifying the speech signal as music if the pitch correlation (Rp) is in closer range of the music threshold value than the unsure threshold value; and classifying the speech signal as background noise if the pitch correlation (Rp) is in closer range of the background noise threshold value than the unsure threshold value. If the pitch correlation (Rp) falls between the music threshold value and the background noise threshold value, classifying the speech signal as music or background noise based on analyzing a plurality of pitch correlations (Rps) extracted from the plurality of frames.

According to another aspect of the present invention, a method is provided for detecting music in a speech signal having a plurality of frames. The method comprises obtaining one or more first pitch correlation candidates from a first frame of the plurality of frames; obtaining one or more second pitch correlation candidates from a second frame of the plurality of frames; selecting a pitch correlation (Rp) from the one or more first pitch correlation candidates and the one or more second pitch correlation candidates; and distinguishing music from background noise based on analyzing the pitch correlation (Rp).

In a further aspect, the method further comprises obtaining one or more third pitch correlation candidates from a third frame of the plurality of frames; obtaining one or more fourth pitch correlation candidates from a fourth frame of the plurality of frames; obtaining one or more fifth pitch correlation candidates from a fifth frame of the plurality of frames; obtaining one or more sixth pitch correlation candidates from a sixth frame of the plurality of frames; obtaining one or more seventh pitch correlation candidates from a seventh frame of the plurality of frames; and obtaining one or more eighth pitch correlation candidates from a eighth frame of the plurality of frames; wherein the selecting includes selecting the pitch correlation (Rp) from the one or more first pitch correlation candidates, the one or more second pitch correlation candidates, the one or more third pitch correlation candidates, the one or more fourth pitch correlation candidates, the one or more fifth pitch correlation candidates, the one or more sixth pitch correlation candidates, the one or more seventh pitch correlation candidates and the one or more eighth pitch correlation candidates.

In an additional aspect, each of the one or more first pitch correlation candidates, the one or more second pitch correlation candidates, the one or more third pitch correlation candidates, the one or more fourth pitch correlation candidates, the one or more fifth pitch correlation candidates, the one or more sixth pitch correlation candidates, the one or more seventh pitch correlation candidates and the one or more eighth pitch correlation candidates consists of four pitch correlation candidates. The method may further comprise filtering the speech signal using a one-order low-pass filter prior to the obtaining the one or more first pitch correlation candidates, and down sampling the speech signal by four prior to the obtaining the one or more first pitch correlation candidates.

Other features and advantages of the present invention will become more readily apparent to those of ordinary skill in the art after reviewing the following detailed description and accompanying drawings.

DETAILED DESCRIPTION OF THE INVENTION

Figure 1:
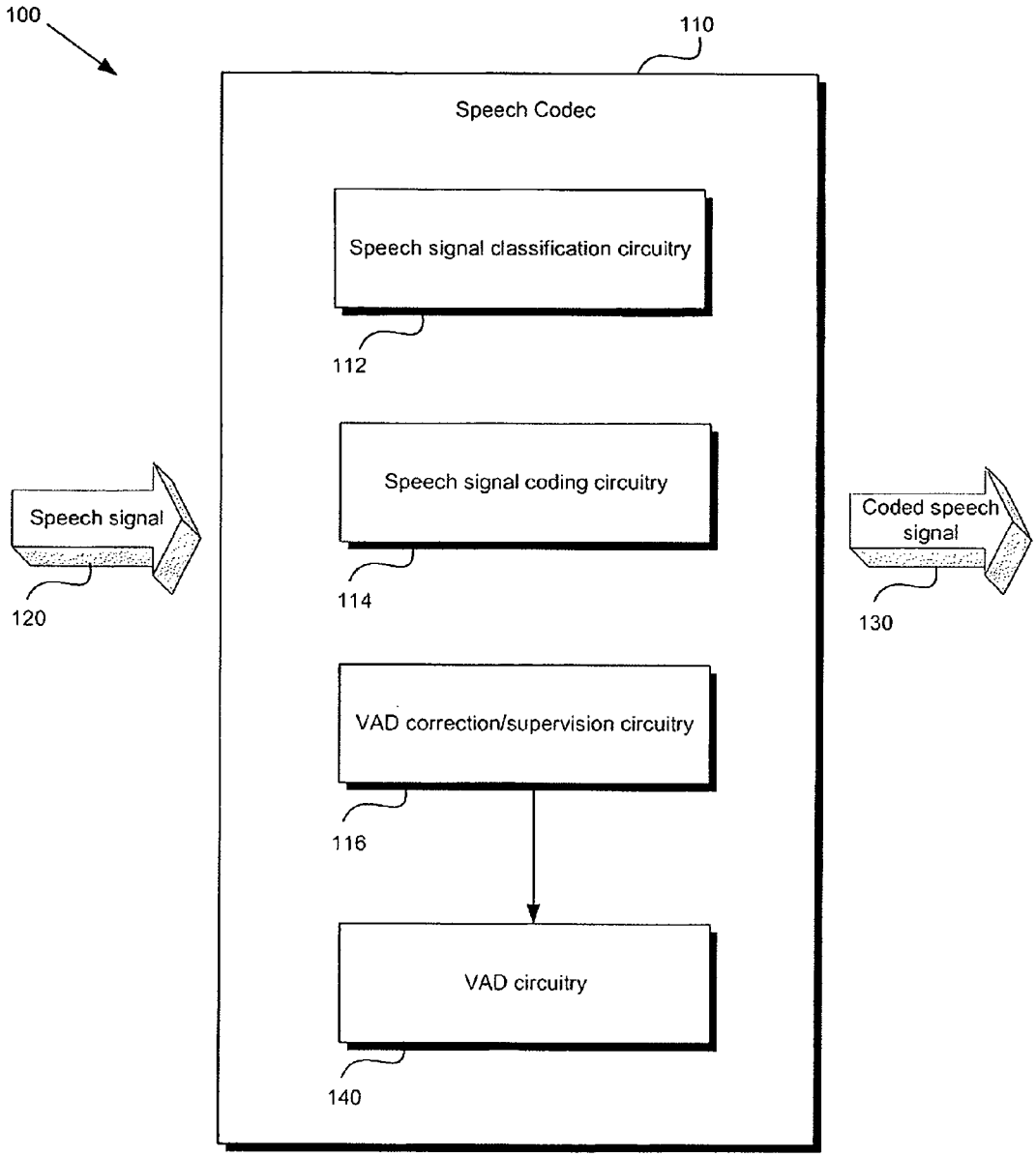
FIG. 1 illustrates a system diagram of a speech coding system, according to one embodiment of the invention.

The present invention is directed to a low-complexity music detection algorithm and system. Although the invention is described with respect to specific embodiments, the principles of the invention, as defined by the claims appended herein, can obviously be applied beyond the specifically described embodiments of the invention described herein. Moreover, in the description of the present invention, certain details have been left out in order to not obscure the inventive aspects of the invention. The details left out are within the knowledge of a person of ordinary skill in the art.

The drawings in the present application and their accompanying detailed description are directed to merely example embodiments of the invention. To maintain brevity, other embodiments of the invention which use the principles of the present invention are not specifically described in the present application and are not specifically illustrated by the present drawings. It should be borne in mind that, unless noted otherwise, like or corresponding elements among the figures may be indicated by like or corresponding reference numerals.

FIG. 1 is a system diagram illustrating an embodiment of a speech coding system 100 built in accordance with an embodiment of the present invention. Speech coding system 100 contains speech codec 110. Speech codec 110 receives speech signal 120 and generates coded speech signal 130. To perform the generation of coded speech signal 130 from speech signal 120, speech codec 110 employs, among other things, speech signal classification circuitry 112, speech signal coding circuitry 114, VAD (voice activity detection) correction/supervision circuitry 116, and VAD circuitry 140. Speech signal classification circuitry 112 identifies characteristics in speech signal 120.

VAD correction/supervision circuitry 116 is used, in certain embodiments according to the present invention, to ensure the correct detection of the substantially music like signal within speech signal 120. VAD correction/supervision circuitry 116 is operable to provide direction to VAD circuitry 140 in making any VAD decisions on the coding of speech signal 120. Subsequently, speech signal coding circuitry 114 performs the speech signal coding to generate coded speech signal 130. Speech signal coding circuitry 114 ensures an improved perceptual quality in coded speech signal 130 during discontinued transmission (DTX) operation, particularly when there is a presence of the substantially music-like signal in speech signal 120.

Speech signal 120 and coded speech signal 130, within the scope of the invention, include a broader range of signals than simply those containing only speech. For example, if desired in certain embodiments according to the present invention, speech signal 120 is a signal having multiple components including a substantially speech-like component. For instance, a portion of speech signal 120 might be dedicated substantially to control of speech signal 120 itself wherein the portion illustrated by speech signal 120 is in fact the substantially speech signal 120 itself. In other words, speech signal 120 and coded speech signal 130 are intended to illustrate the embodiments of the invention that include a speech signal, yet other signals, including those containing a portion of a speech signal, are included within the scope and spirit of the invention. Alternatively, speech signal 120 and coded speech signal 130 would include an audio signal component in other embodiments according to the present invention.

Figure 2:
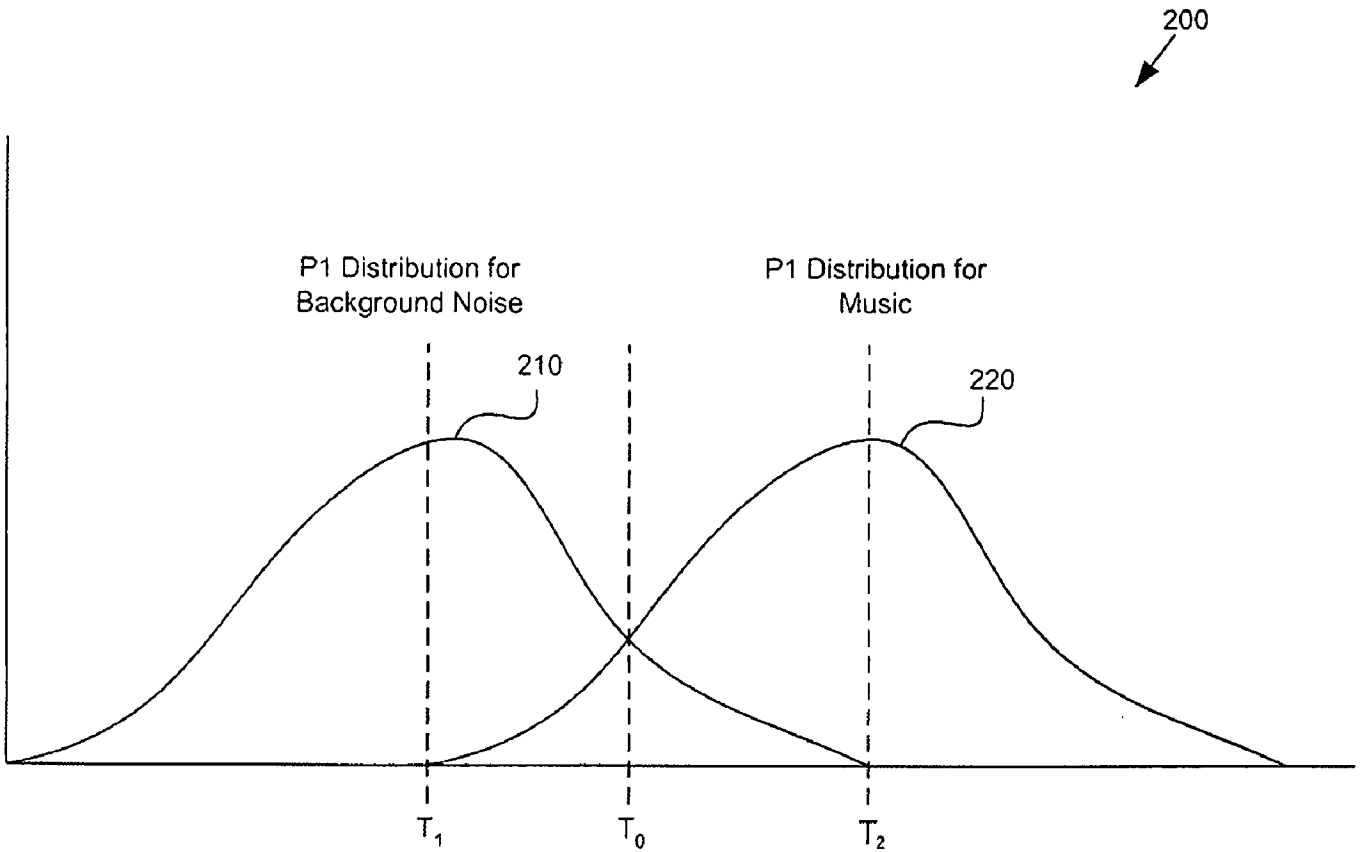
FIG. 2 illustrates a distribution graph of a speech coding parameter for background noise and music, according to one embodiment of the invention.

FIG. 2 illustrates distribution graph 200 of a speech coding parameter for background noise and music, according to one embodiment of the invention. Background noise distribution 210 and music distribution 220 are shown for example samples of music and noise, respectively, taken over a period of time. The horizontal axis represents the value of an example speech coding parameter $P_1$, and the vertical axis represents the probability that the parameter will have the respective value on the horizontal axis. The speech coding parameter $P_1$ can be calculated by a speech coder, such as a G.729 coder. Speech coding parameter $P_1$ can represent various speech coding parameters, including pitch correlation ($R_p$), linear prediction coding (LPC) gain, and the like. In one embodiment, a single speech coding parameter $P_1$ can be used for differentiating between music and background noise, as discussed below. However, in other embodiments, more than one speech coding parameter may be used, which can represent multi-dimensional vectors, and which are discussed herein.

Referring to FIG. 2, threshold value $T_1$ represents the value of $P_1$ to the left of which the speech frame being processed is deemed to be background noise. Likewise, threshold value $T_2$ represents the value of $P_1$ to the right of which the speech frame being processed is deemed to be music. Threshold value $T_0$ represents the value of $P_1$ at the intersection of background noise distribution 210 and music distribution 220. In the example shown, music distribution 220 and background noise distribution 210 can represent the distribution of the pitch correlation ($R_p$) for music frames and background noise frames, respectively. It should be noted that for other speech coding parameters, background noise distribution 210 might be to the right of music distribution 220 depending upon what parameter $P_1$ represents.

Since in one embodiment, speech coding parameter $P_1$, such as the pitch correlation ($R_p$), has already been calculated by the speech coder, such as the G.729 coder, the present scheme substantially reduces complexity and time by receiving speech coding parameter $P_1$ from the speech coder and using the same to differentiate between background noise and music in a VAD module, such as VAD circuitry 140 or a VAD software module, for example.

Embodiments according to the present invention can be implemented as a software upgrade to a VAD module (such as VAD circuitry 140, for example), wherein the software upgrade includes additional functionality to the functionality in the VAD module, etc. The software upgrade can determine if a given sample of the speech signal should be classified as music or background noise, and advantageously uses one or more speech coding parameters (e.g. $P_1$) already calculated by speech signal coding circuitry 114. Whether the speech signal is classified as music or background noise will determine whether the signal is to be encoded with a high bit-rate coder or a low bit-rate coder. For example, if the speech signal is determined to be music, encoding with a high bit rate encoder might be preferable.

In one embodiment, the present invention may be implemented to override the output of the VAD if the VAD's output indicates background noise detection, but the software upgrade of the present invention determines that the speech signal is a music signal and that a high bit-rate coder should be utilized, as described in U.S. Pat. No. 6,633,841, entitled "Voice Activity Detection Speech Coding to Accommodate Music Signals," issued Oct. 14, 2003, which is hereby incorporated by reference.

In one embodiment, for a given speech frame under examination, if $P_1$ is less than $T_1$ (or in closer range of $T_1$ than to $T_0$) then $P_1$ is indicative of background noise. If $P_1$ is greater than $T_2$ (or in closer range of $T_2$ than $T_0$) then $P_1$ is indicative of music. However, if $P_1$ falls in the range between $T_1$ and $T_2$ then additional computation is required to determine whether $P_1$ is indicative of background noise or music. The flowchart of FIG. 3 illustrates one example approach for determining whether the speech signal is music or background noise if $P_1$ falls in the range between $T_1$ and $T_2$.

It should be noted that certain details and features have been left out of flowchart 300 that are apparent to a person of ordinary skill in the art. For example, a step may consist of one or more substeps or may involve specialized equipment, as is known in the art. While steps 302 through 322 indicated in flowchart 300 are sufficient to describe one embodiment of the present invention, other embodiments of the invention may use steps different from those shown in flowchart 300.

Figure 3:
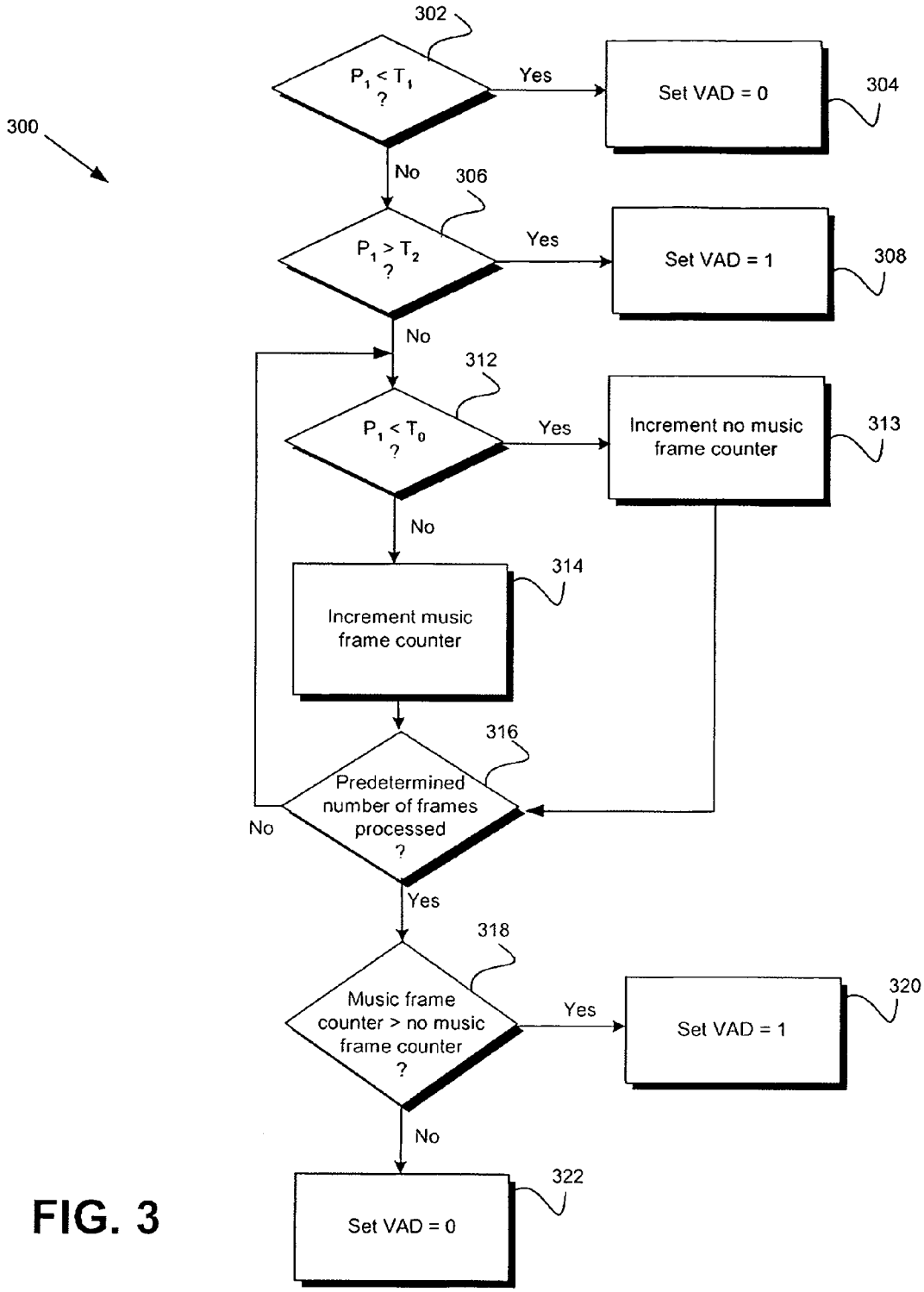
FIG. 3 illustrates a method of differentiating background noise from music using one parameter, according to one embodiment of the invention.

In one embodiment, according to FIG. 3, the process begins by examining the value of speech coding parameter $P_1$, such as pitch correlation, for a given speech frame. At the outset, the VAD may be set to a default value to indicate music or speech (as opposed to background noise, for example), such that a high bit-rate coder is utilized to code the frames. In this way, even though more bandwidth is used to code the frame, the coding system favors quality in the event that the speech signal is in fact a music signal. As shown in FIG. 3, at step 302, speech coding parameter $P_1$ is received from the speech coder and if it is less than $T_1$ then the frame is classified as background noise and the VAD output is set to zero in step 304 to indicate the same. Otherwise, the process moves to step 306 and if $P_2$ is greater than $T_2$ then the frame is classified as music and at step 308 the VAD is set to one to indicate the same. However, if speech coding parameter $P_1$ falls in between $T_1$ and $T_2$, then the process moves to step 312 for additional calculations for a predetermined number of frames, such as 100 to 200 frames for example.

At step 312, if $P_1$ is less than $T_0$ then the no music frame counter (cnt_nomus) is incremented at step 313. If $P_1$ is not less than $T_0$ at step 312 then the process proceeds to step 314. Otherwise, if $P_1$ is greater than $T_0$ then the music frame counter (cnt_mus) is incremented at step 314.

At step 316, a check is made to determine if the predetermined number of speech frames have been processed. If there is another speech frame to be examined, the process loops back to step 312. However, if the predetermined number of speech frames have been processed the process proceeds to step 318.

At step 318, the value of the music frame counter is compared to the value of the no music frame counter. If the music frame counter is greater than the no music frame counter (or in one embodiment, it is greater than the no music frame counter by a threshold value W), then the process proceeds to step 320, where the frame is classified as music and the VAD is set to one to indicate the same.

Otherwise, the process proceeds to step 322, where the frame is classified as background noise and the VAD is set to zero to indicate the same.

In one embodiment, the VAD may have more than two output values. For example, in one embodiment, VAD may be set to "zero" to indicate background noise, "one" to indicate voice, and "two" to indicate music. In such event, a medium bit-rate coder may be used to code voice frames and a high bit-rate coder may be used to code music frames. In the embodiment of FIG. 3, if the music frame counter is within W of the no music frame counter, then VAD may be set to "one" rather than "two", so that a medium bit rate coder is used. In another embodiment, instead of using a medium bit-rate coder, further calculations are performed to further differentiate between background noise distribution 210 and music distribution 220.

In one embodiment, after the speech signal is classified as music and the speech frames are being coded accordingly, if a non-music speech frame is detected for a given period of time (or an extension period), such as a time period for processing 30 frames, the detection system continues to indicate that a music signal is being detected until it is confirmed that the music signal has ended. This technique can help to avoid glitches in coding.

Figure 4:
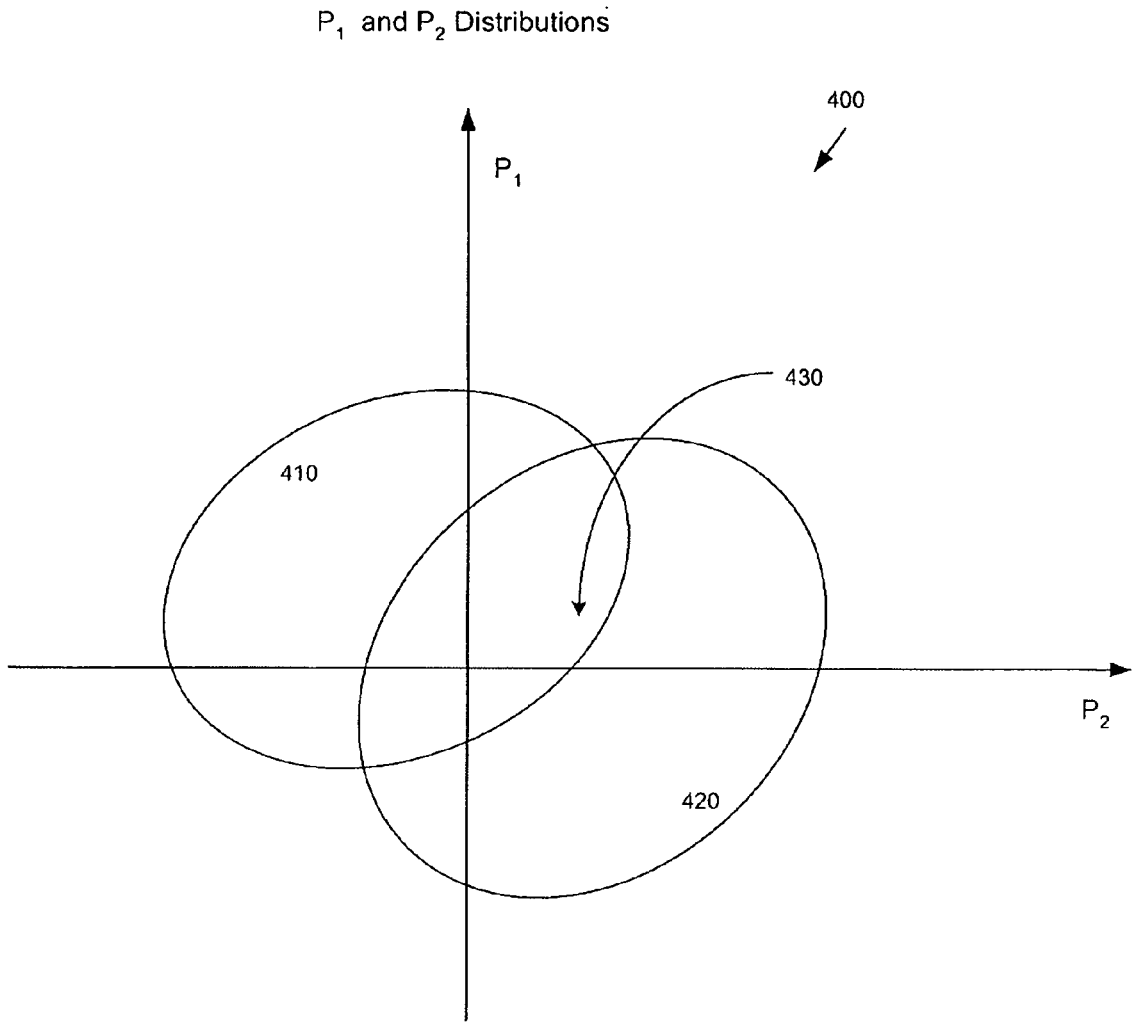
FIG. 4 illustrates a distribution graph of two speech coding parameters for background noise and music, according to one embodiment of the invention.

FIG. 4 illustrates distribution graph 400 for two speech coding parameters, according to one embodiment of the invention. In this embodiment, distribution graph 400 represents a two-dimensional distribution of a first speech coding parameter $P_1$ and a second speech coding parameter $P_2$.

In one embodiment, reference numeral 410 represents an area mostly indicative of background noise. Reference numeral 420 represents an area mostly indicative of music. Reference numeral 430 represents the intersection of areas 410 and 420. Area 430 is an indeterminate area that can be handled in a manner similar to that disclosed in steps 312 to 322 of FIG. 3, for example. In one embodiment, two speech coding parameters, such as pitch correlation ($R_p$) and linear prediction coding (LPC) gain, are utilized to differentiate music from background noise.

Figure 5:
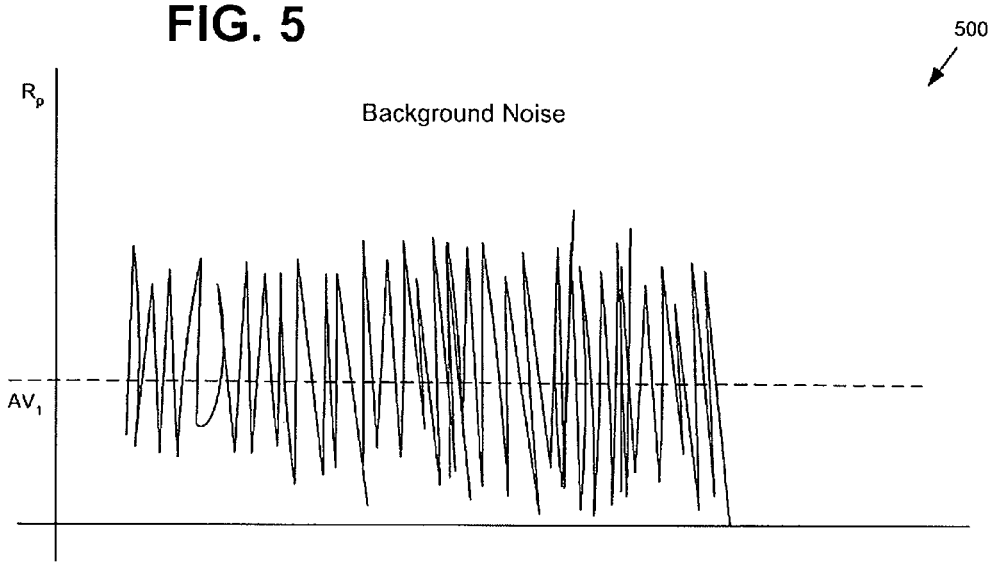
FIG. 5 illustrates an average pitch correlation for a background noise waveform, according to one embodiment of the invention.
Figure 6:
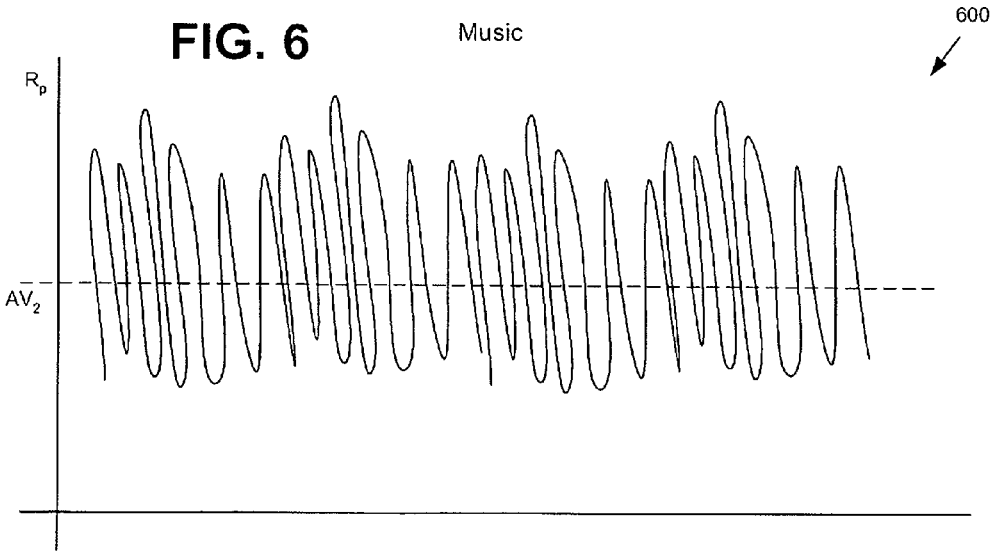
FIG. 6 illustrates an average pitch correlation for a music waveform, according to one embodiment of the invention.

Referring to FIGS. 5 and 6, as mentioned herein, noise signals are typically fairly stable relative to voice signals. The frequency spectrum of voice signals (or unvoiced signals) is rapidly in flux. On the other hand, background noise signals exhibit the same or similar frequency for a relatively long period of time, and hence there is more stability. Therefore, in conventional approaches, differentiating between voice signals and background noise signals is fairly simple and is based on signal stability. Unfortunately, music signals are also typically relatively stable for a number of frames (e.g. several hundred frames). For this reason, conventional voice activity detectors often fail to differentiate between background noise signals and music signals, and would exhibit rapidly fluctuating outputs for music signals.

FIG. 5 illustrates a background noise waveform, where the vertical axis represents $R_p$ and the horizontal axis represents time. The average value of $R_p$ for the background noise waveform is referred to as $AV_1$.

FIG. 6, on the other hand, illustrates a music waveform, where the vertical axis represents $R_p$ and the horizontal axis represents time. The average value of $R_p$ for the music waveform is referred to as $AV_2$ . It is noteworthy that $AV_2$ is typically greater than $AV_1$. However, there are times when the average value of a parameter for a background noise signal is very close to the average value of a parameter for a music signal. In other words, there are times when $AV_1$ is very close to $AV_2$. As a result, it may be difficult to differentiate between background noise and music using such a speech coding parameter.

In one embodiment of the present invention, it is desirable to create more separation between $AV_1$ and $AV_2$, such that the distribution curves of FIG. 2 are further separated to cause the threshold values $T_0$, $T_1$, and $T_2$ to be sufficiently apart to make the decision making based on $P_1$ more robust. The separation between the background noise distribution and the music distribution can be increased using the stability of the music signal, thus making the distributions more distinguishable. $T_0$ this end, the pitch of a previous frame is used to calculate the $R_p$ value, and as a result, $AV_1$ further drops lower, whereas $AV_2$ does not materially change. The reason for $AV_2$ not materially changing is that music spectrums typically change very slowly. This technique advantageously serves to increase the separation between the background noise distribution and the music distribution for $R_p$.

In the embodiments where the LPC gain is used as a differentiating speech coding parameter, another technique can be implemented for increasing the separation between the background noise distribution and the music distribution, as follows.

Typically, LPC gain is calculated by the following equation:

$$LPC\ \text{gain} = \prod_{i=2}^{9} (1 - K_i^2) \qquad \text{(Equation 1)}$$

where $K$ is a refraction coefficient

However, if $K_i$ equals 1, even for one index, the entire product equals 0. Therefore, this equation is not desirable for distinguishing between background noise and music. Therefore, in one embodiment of the present invention, $LPC_{avg}$ is calculated by the following equation:

$$LPC_{avg} = \sum_{i=2}^{9} |K_i| \qquad \text{(Equation 2)}$$

Using Equation 2, $LPC_{avg}$ is typically smaller for background noise than for music. Thus, separation between the background noise distribution and the music distribution is increased.

As mentioned herein, an Appendix is included, which comprises an example computer program listing according to one embodiment of the invention. This program listing is simply one specific implementation of one embodiment of the present invention.

Figure 7A:
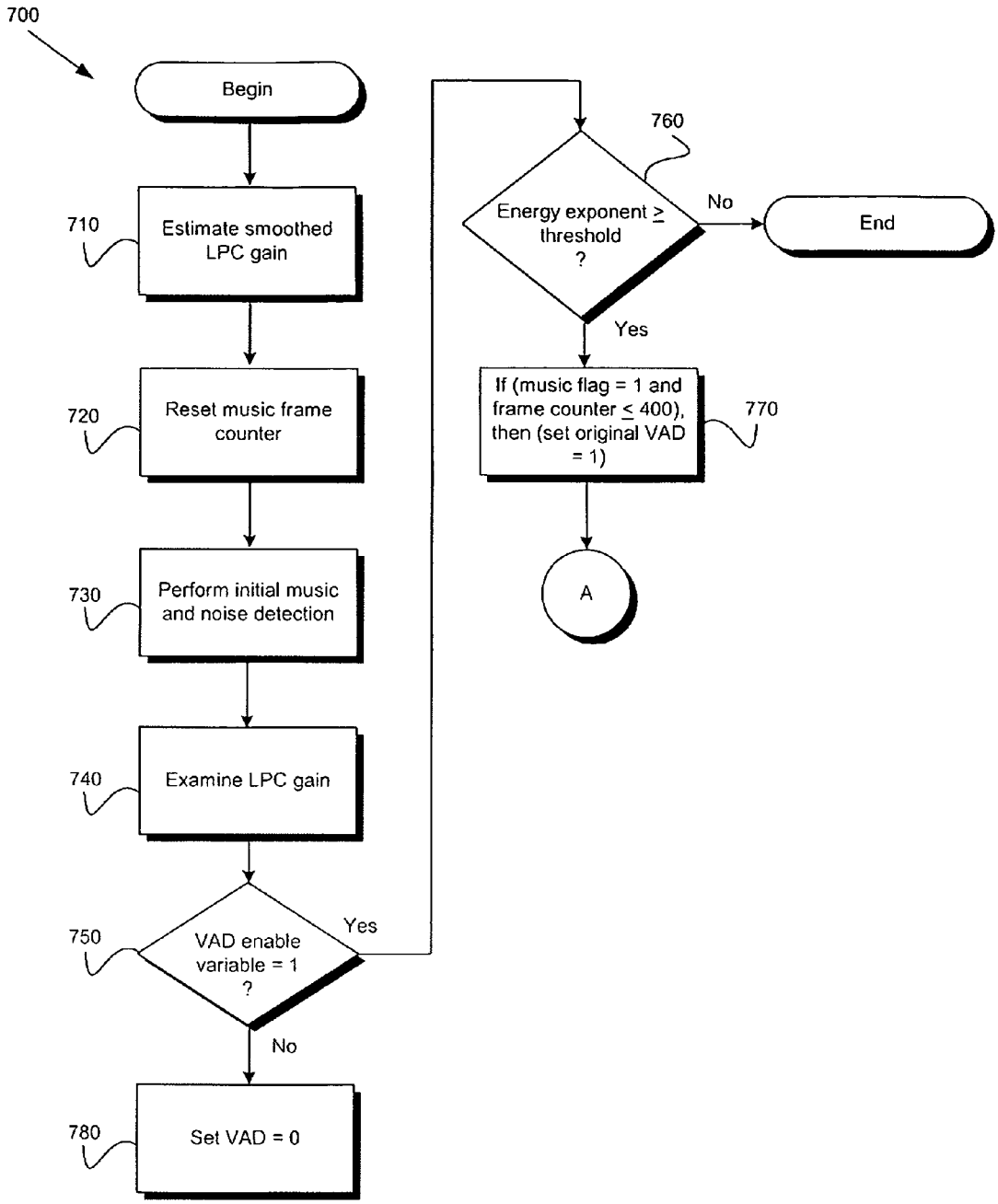
FIGS. 7A and 7B illustrate a method of differentiating background noise from music using two parameters, according to one embodiment of the invention.
Figure 7B:
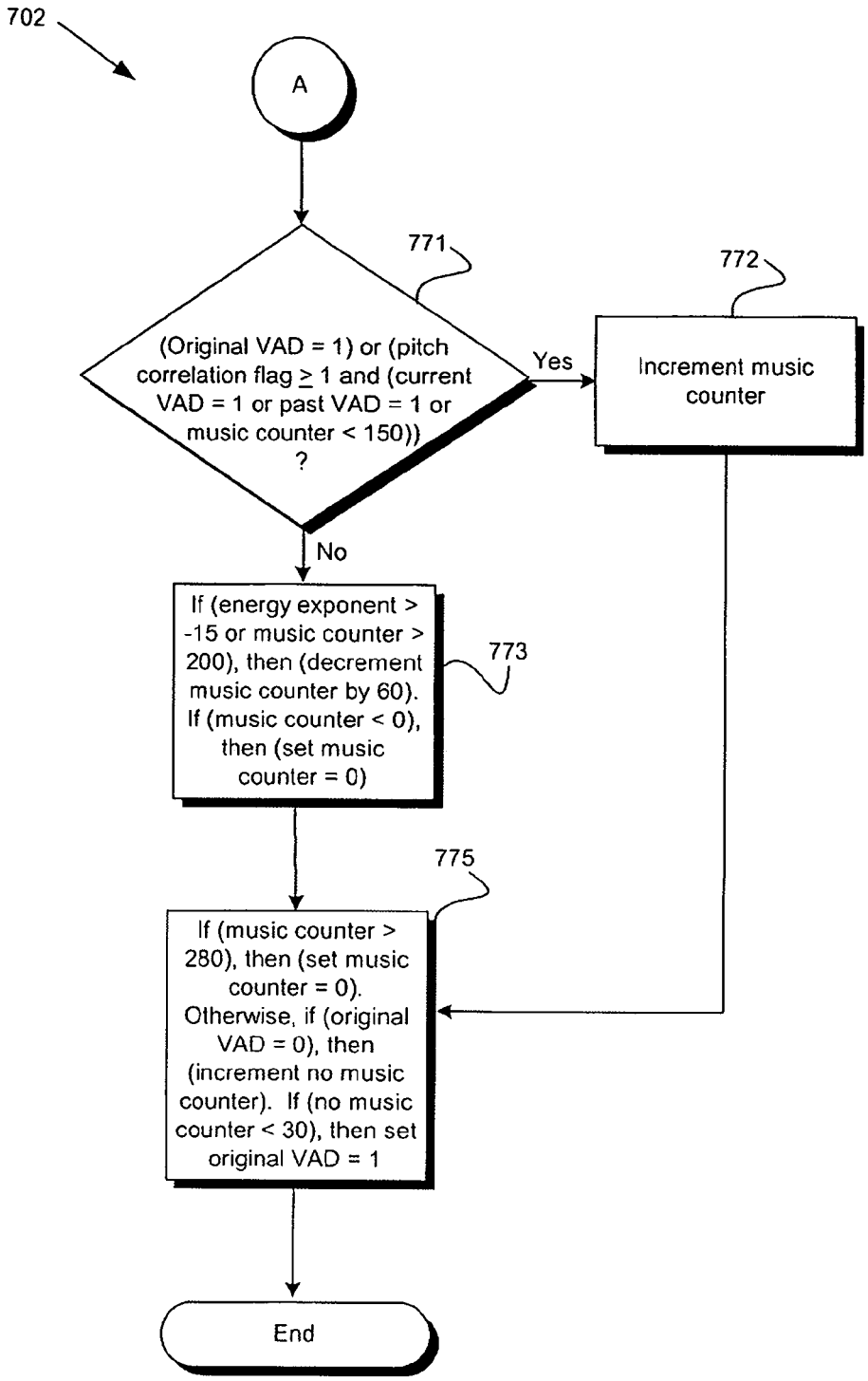

FIGS. 7A and 7B include flowcharts 700 and 702, respectively, and represent the flow of the code in the Appendix. It should be noted that certain details and features have been left out of flowcharts 700 and 702 that are apparent to a person of ordinary skill in the art. For example, a step may consist of one or more substeps or may involve specialized equipment, as is known in the art. While steps 710 through 780 indicated in flowcharts 700 and 702 are sufficient to describe one embodiment of the present invention, other embodiments of the invention may use steps different from those shown in flowcharts 700 and 702.

Referring to the attached Appendix and FIGS. 7A and 7 B, Rp_flag is the pitch correlation flag and can have values of −1, 0, 1, or 2 in one embodiment. The larger the value of Rp_flag the more periodic the signal is, indicating a greater likelihood of the signal representing music. The variable rc[i] represents the reflection coefficients. It is possible for i to have an integer value from 0 to 9. The original, current, and past VAD variable values are represented by Vad, pastVad, and ppastVad, respectively. The energy exponent is represented by exp_R0. The larger the energy exponent is the higher the energy of the signal. The frame variable is a frame counter, representing the current speech frame.

At step 710, the smoothed LPC gain, refl_g_av, is estimated from the reflection coefficients of orders 2 through 9.

At step 720, the music frame counter, cnt_mus, is reset if the conditions are appropriate.

At step 730, initial music and noise detection is performed. Various calculations are performed to determine if music or noise has most likely been detected at the outset. A noise flag, nois_flag, is set equal to one indicating that noise has been detected. Alternatively, if a music flag, mus_flag, is equal to one then it is assumed that music has been detected. Step 730 is shown in greater detail in FIG. 8.

At step 740, the LPC gain is examined. If the LPC gain is high then the pitch correlation flag, Rp_flag, is modified. Specifically, if the LPC gain is greater than 4000 and the pitch correlation flag is equal to 0 then the pitch correlation flag is set equal to one, in one embodiment.

At step 750, if a VAD enable variable, vad_enable, is equal to one then the process proceeds to step 760. Otherwise the process proceeds to step 780.

At step 760, if the energy exponent is greater than or equal to a given threshold, −16 in one embodiment, then the process proceeds to step 770. Otherwise, if the energy exponent is not greater than or equal to −16, then the process ends.

At step 770, if Condition 1, Cond1, is true then the original VAD is set equal to one. That is, if the music flag is equal to one and the frame counter is less than or equal to 400, the VAD is set equal to one.

At step 771, if the original VAD is equal to one or Condition 2, Cond2, is true, then the music counter is incremented at step 772. It is noted that Condition 2 is true when the pitch correlation flag is greater than or equal to one and (the current VAD is equal to one or the past VAD is equal to one or the music counter is less than 150) then the music counter is incremented at step 772. Otherwise, the process proceeds to step 773. At step 772, if the music counter is greater than 2048 then the music counter is set equal to 2048.

At step 773, the energy exponent and the music counter are examined. If the energy exponent is greater than −15 or the music counter is greater than 200 then the music counter is decremented by 60, in one embodiment. If the music counter is less than zero then the music counter is set equal to zero.

At step 775, the music counter is examined. If the music counter is greater than 280 then the music counter is set equal to zero, in one embodiment. Otherwise, if the original VAD is equal to zero then the no music counter is incremented. At step 775, if a no music counter is less than 30, then the original VAD is set equal to one, in one embodiment. The process subsequently ends at this point.

At step 780, processing for a signal having a very low energy is performed. Specifically, if the frame counter is greater than 600 or the music counter is greater than 130 then the music frame counter is decreased by a value of four, in one embodiment. If the music frame counter is greater than 320 and the energy exponent is greater than or equal to −18 then the original VAD is set equal to one, in one embodiment. If the music frame counter is less than zero then the music counter is set equal to zero.

Figure 8:
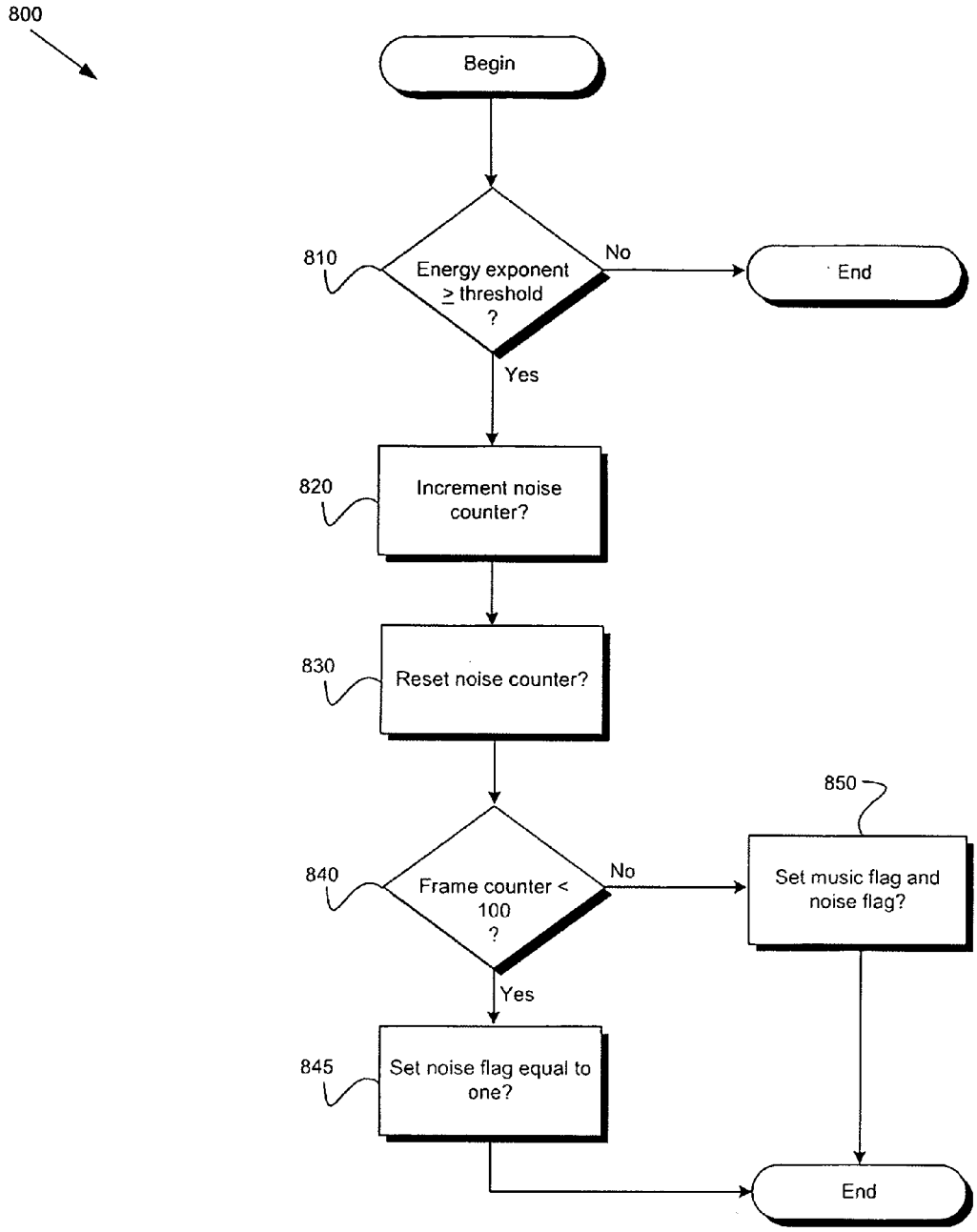
FIG. 8 illustrates a method of performing initial background noise and music detection, according to one embodiment of the invention.

Referring to FIG. 8, flowchart 800 represents an example flow of step 730 of FIG. 7A in greater detail. It should be noted that certain details and features have been left out of flowchart 800 that are apparent to a person of ordinary skill in the art. For example, a step may consist of one or more substeps or may involve specialized equipment, as is known in the art. While steps 810 through 850 indicated in flowchart 800 are sufficient to describe one embodiment of the present invention, other embodiments of the invention may use steps different from those shown in flowchart 800.

It is noted that a purpose of step 730 of FIG. 7A is to perform initial music and noise detection, as mentioned herein. Various calculations are performed to determine if music or noise has most likely been detected at the outset. A noise flag, nois_flag, is set equal to one indicating that noise has been detected. Alternatively, if a music flag, mus_flag, is equal to one then it is assumed that music has been detected. Steps analogous to the particular sequence of steps that comprise step 730 of FIG. 7A can also be used in conjunction with the beginning of the flow of FIG. 3, in one embodiment.

At step 810, if the energy exponent is greater than or equal to a given threshold, such as −16 for example, the process proceeds to step 820. Otherwise at this point step 730 of FIG. 7A ends.

At step 820, if the current value of VAD is equal to one and the pitch correlation flag is less than one, then the noise counter is incremented by a value of one minus the value of the pitch correlation flag, in one embodiment.

At step 830, in one embodiment, the noise counter is set equal to zero if a certain condition is true. The condition is whether the pitch correlation flag is equal to two, the smoothed LPC gain is greater than 8000, or the zero order reflection coefficient is greater than 0.2*32768.

At step 840, a check is made to determine if the frame counter is less than 100. If the answer is yes, the process proceeds to step 845. If the answer is no, the process proceeds to step 850.

At step 845, the noise flag is set equal to one if a certain condition is true. The condition, in one embodiment, is whether (the noise counter is greater than or equal to 10 and the frame is less than 20, or the noise counter is greater than or equal to 15) and (the zero order reflection coefficient is less than −0.3*32768 and the smoothed LPC gain is less than 6500).

At step 850, the music flag and noise flag are set under certain conditions. If the noise flag is not equal to one then the music flag is set equal to one. If the noise frame counter is less than four and the music frame counter is greater than 150 and the frame counter is less than 250 then the music flag is set equal to one and the noise flag is set equal to zero, in one embodiment. Subsequently, step 730 of FIG. 7A ends.

Figure 9:
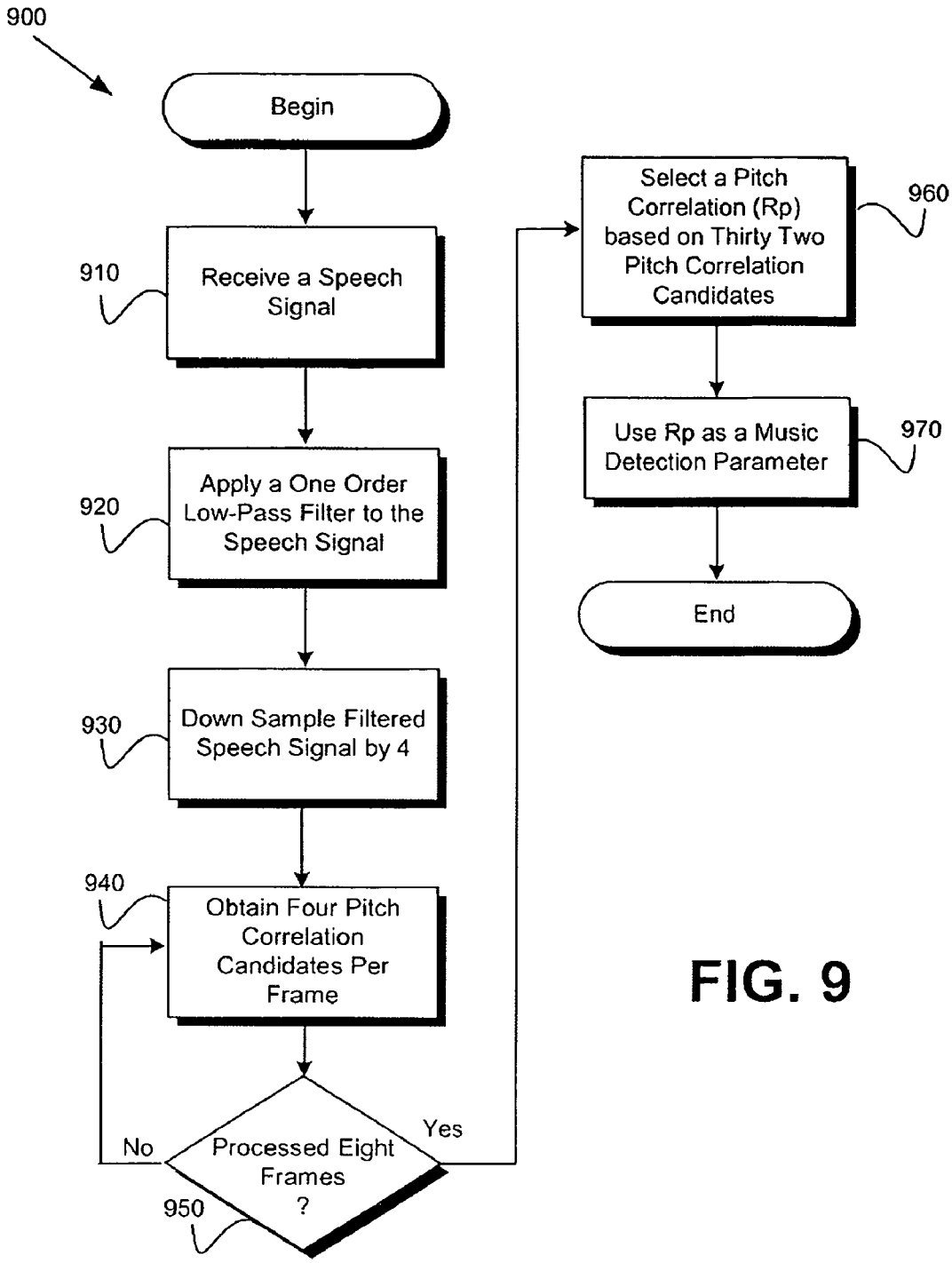
FIG. 9 illustrates a method of performing low-complexity pitch correlation calculation for music detection, according to one embodiment of the invention.

FIG. 9 illustrates low-complexity pitch correlation calculation method 900 for music detection, according to one embodiment of the invention. In certain embodiments of the present invention, where pitch correlation ($R_p$) information is not available from a speech coder or where a music detector of the present invention is used as a standalone music detector, or the like, low-complexity pitch correlation calculation method 900 provides processor bandwidth and power savings for music detection.

In conventional speech coding systems, pitch correlation ($R_p$) calculation is quite complex and time consuming. In such systems, one pitch correlation (Rp) is calculated per frame, where Rp is the largest pitch correlation among 128 pitch correlation candidates that are calculated per frame. In some conventional systems, the speech signal may be down sampled, for example, by four (4), where Rp is the largest pitch correlation among 32 pitch correlation candidates that are calculated per frame.

Various embodiments according to the present invention, however, reduce complexity and time consumption by taking into account the fact that pitch correlation (Rp) is being calculated for music detection and not speech coding, and that pitch correlation (Rp) changes less rapidly during music, since a music signal typically lasts for a few seconds. Accordingly, in an embodiment of the present invention, pitch correlation (Rp) is calculated for a number of frames at a time.

Figure 10:
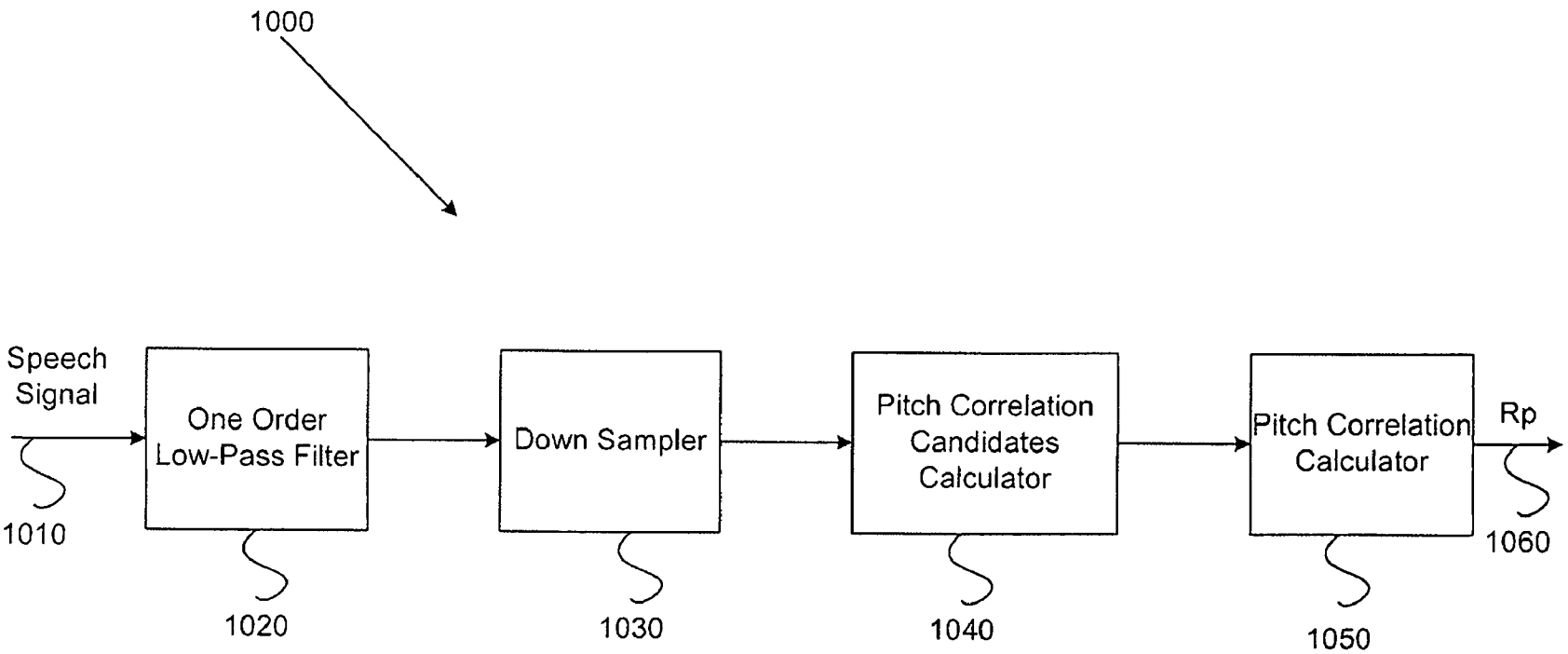
FIG. 10 illustrates pitch correlation calculation system for music detection, according to one embodiment of the present invention.

FIG. 10 illustrates pitch correlation calculation system 1000 for music detection, according to one embodiment of the present invention. As shown, speech signal 1010 is filtered using a one-order low-pass filter 1020, which can be an LP filter defined as $(1-Z^{-1})$. One-order low-pass filter 1020 reduces complexity compared to conventional pitch correlation calculation systems that use higher order filters. Because pitch correlation calculation system 1000 is utilized for music detection, and not speech coding, a one-order low-pass filter 1020 can be used to reduce complexity. Next, in one embodiment, the filter signal is down sampled by down sampler 1030, e.g. by four (4), to reduce the number pitch correlation candidates for calculating pitch correlation (Rp) from 128 to 32, which reduces the complexity by 4, since 4 times less pitch correlation candidates will be calculated. Further, in contrast to conventional pitch correlation calculation systems that calculate the total number of pitch candidates required for calculating the pitch correlation (Rp) in a single frame, e.g. 128 pitch correlation candidates in a single frame (or 32 pitch correlation candidates in a single frame if down sampled by 4), pitch correlation candidates calculator 1040 does not calculate the total number of pitch correlation candidates for calculating one pitch correlation (Rp) from a single frame. For example, in one embodiment, pitch correlation candidates calculator 1040 calculates four (4) pitch correlation candidates per frame after down sampling by down sampler 1030 by four (4). Further, unlike conventional pitch correlation systems that calculate one pitch correlation (Rp) per frame based on the total number of pitch correlation candidates obtained from that frame, pitch correlation calculator 1050 calculates one pitch correlation (Rp) per two or more frames. For example, in one embodiment, after down sampling speech signal 1010 by four (4) and calculating four (4) pitch correlation candidates per frame, pitch correlation calculator 1050 calculates one pitch correlation (Rp) 1060 per eight frames. As a result, in the preceding example, the complexity is reduced by about eight times. Accordingly, pitch correlation calculation system 1000 of the present invention substantially reduces complexity and time for pitch correlation (Rp) 1060 detection for use in music detection.

Turning back to FIG. 9, low-complexity pitch correlation calculation method 900 begins at step 910, where pitch correlation calculation system 1000 receives speech signal 1010. Next, at step 920, one-order low-pass filter 1020 is applied to speech signal 1010 to generate a filtered speech signal. At step 930, the filtered speech signal is down sampled, for example, by four (4). At step 940, four (4) pitch correlation candidates are obtained from each frame. In some embodiments, any number of pitch correlation candidates less than the total candidates required for calculating one pitch correlation (Rp) can be obtained from each frame. In one example, sixteen (16) pitch correlation candidates may be obtained from each frame, and in another example, one pitch correlation candidate may be obtained from each frame. Next, at step 950, it is determined whether a sufficient number of candidates are obtained for calculating one pitch correlation (Rp). For example, in an embodiment that speech signal is down sampled by four (4), and where four (4) pitch correlation candidates are obtained per frame, step 950 determines whether eight (8) frames have bee processed to yield thirty-two (32) pitch correlation candidates. Yet, in an embodiment that speech signal is down sampled by four (4), and where one (1) pitch correlation candidate is obtained per frame, step 950 determines whether thirty-two (32) frames have bee processed to yield thirty-two (32) pitch correlation candidates. If a sufficient number of frames have not been processed, method 900 moves to step 940, otherwise, method 900 moves to step 960.

At step 960, pitch correlation calculation system 1000 generates pitch correlation (Rp) 1060 based on the pitch correlation candidates, which can be the largest pitch correlation candidates. Next, at step 970, pitch correlation (Rp) 1060 is utilized to determine whether speech signal 1010 contains a music signal. In one embodiment, pitch correlation (Rp) 1060 can be used in conjunction with the music detection methods and systems described in the present application.

From the above description of the invention it is manifest that various techniques can be used for implementing the concepts of the present invention without departing from its scope. Moreover, while the invention has been described with specific reference to certain embodiments, a person of ordinary skill in the art would recognize that changes can be made in form and detail without departing from the spirit and the scope of the invention. For example, it is contemplated that the circuitry disclosed herein can be implemented in software, or vice versa. The described embodiments are to be considered in all respects as illustrative and not restrictive. It should also be understood that the invention is not limited to the particular embodiments described herein, but is capable of many rearrangements, modifications, and substitutions without departing from the scope of the invention.

APPENDIX

```
#include <stdio.h>
#include <math.h>
#include "typedef.h"
#include "basic_op.h"
#include "oper_32b.h"
#ifdef MUSIC_VAD_MSPD /* Making Vad=1 and Music_flag=1 for music signal */
#define   MUS_MAX_PIT 30
#define   MUS_MIN_PIT 6
#define   MUS_L_NEW 30
#define   MUS_L_BUFF (MUS_MAX_PIT+MUS_L_NEW)
```

APPENDIX-continued

```
#define   MUS__N__CORR 4
#define   MUS__CNT 60
void Music__detect__fx(
   short *sig,        /* (i) : input signal                          */
   short l__sig,          /* (i) : length of input signal                    */
   short *Music__flag        /* (o) : side infomation : *Music__flag=1 if music is true */
   )
   {
   /* static variables */
   static Word16 L__M__fx, L__F__fx, N__CORR__fx, THRD__fx;
   static Word16 buff__mus__fx[MUS__L__BUFF]={0}, Z1__mem__fx=0;
   static Word16 low__pit__fx, high__pit__fx=MUS__MIN__PIT;
   static Word16 Pitch__fx=20, Pitch__new__fx=20, Pitch__old__fx=20;
   static Word32 R__max__fx=1, R0__fx=1, R0__av__fx;
   static Word32 Rp__fx=0, Rp__old__fx=0;
   static Word32 Energy__av__fx=0x00666666 /* 32. */;
   static Word32 Energy__fx, Energy__old__fx=0x00033333 /* 1. */; /* (X/10)*2^21 */
   static Word32 dE__av__fx=0, dE__fx=0x0;
   static Word32 r1__fx=0x0;
   static Word16 mus__flag__fx=0;
   static Word32 Frm__cnt__fx=0;
   static Word16 cnt__mus__fx=1;
   static Word16 cnt__pit__fx=0;
   static Word16 cnt__p__fx=0, cnt__b__fx=0, cnt__s__fx=0, cnt__m__fx=0, cnt__n__fx=0;
   static Word 16 class__sig__fx=0;
   static Word16 cnt0__fx=0, cnt1__fx=0, cnt2__fx=0;
/* variables */
Word16 silence__flag__fx=0;
Word32 R__fx;
Word16 *ptr__fx;
Word16 Cond1__fx, Cond2__fx, Cond3__fx, Cond4__fx, Cond5__fx;
Word16 i, k;
Word16 intg,frac; /* used in the Log calculation */
Word16 hi, lo;    /* used in the division */
Word32 L__temp1, L__temp2;
Word16 nrm, temp;
Word 16 Music__flag__fx;
/*-----------------------------------------------------------------/*
/*---------     Initial                    -----------------------*/
/*-----------------------------------------------------------------/*
if (Frm__cnt__fx==0) {
      if (l__sig==80) { N__CORR__fx=4; L__F__fx = 20; THRD__fx=6; }
      else { printf(" Wrong frame size ! \n"); exit(0); }
      L__M__fx = sub(MUS__L__BUFF, L__F__fx);
      }
Frm__cnt__fx++;
/*-----------------------------------------------------------------/*
/*--------              low-pass filter and down sampling by 4 --------*/
/*-----------------------------------------------------------------/*
for (i=0;i<L__M__fx;i++) buff__mus__fx[i]=buff__mus__fx[i+L__F__fx];
buff__mus__fx[L__M__fx]=shr(sig[0], 1) + Z1__mem__fx;
for (i=L__M__fx+1, k=4; i<MUS__L__BUFF; i++, k+=4) {
      buff__mus__fx[i] = add(shr(sig[k], 1), shr(sig[k-1], 1)); /* Q-1 to avoid overflow */
      }
Z1__mem__fx=shr(sig[l__sig-1], 1);
/*-----------------------------------------------------------------/*
/*              signal classification                                  */
/*-----------------------------------------------------------------/*
/*Energy*/
R0__fx=MUS__L__NEW*16/2;
for (k=0;k<MUS__L__NEW;k++) {
      R0__fx = L__mac(R0__fx, buff__mus__fx[k], buff__mus__fx[k]);
   }
R0__av__fx = L__add(L__shr(R0__av__fx,2) , L__add(L__shr(R0__fx,2), L__shr(R0__fx,1)));
/* Silence detector */
Log2(R0__fx, &intg, &frac);
Energy__fx = L__Comp(intg, frac);
Energy__fx = L__shl(Energy__fx, 5); /*Q21*/
L__Extract(Energy__fx, &intg, &frac);
Energy__fx = Mpy__32__16(intg, frac, 9864);
L__Extract(Energy__fx, &intg, &frac);
L__temp1 = Mpy__32__16(intg, frac, /*1/128*/ 256);
L__Extract(Energy__av__fx, &intg, &frac);
Energy__av__fx = L__add(L__temp1, Mpy__32__16(intg, frac, /*127/128*/32512));
if (L__sub(Frm__cnt__fx, 4*THRD__fx) <0 && L__sub(dE__av__fx, /*10*/0x00200000)>0)
      Energy__av__fx=Energy__fx;
silence__flag__fx=0;
dE__av__fx = L__sub(Energy__fx, Energy__av__fx);
if (L__sub(Energy__fx, /*26*/0x00533333)<0x0 || L__sub(dE__av__fx, /*-20*/0xFFC00000)<0)
```

APPENDIX-continued

```
    silence_flag_fx = 1;
/* Signal classes */
if ((L_sub(dE_av_fx, /*-5*/0xFFF00000)>0) && (L_sub(dE_av_fx, /*8*/0x0019999A)<0) ) {
      cnt_n_fx=add(cnt_n_fx, N_CORR_fx);
      cnt_p_fx=0;
   }
else {
   cnt_n_fx=0;
   cnt_p_fx =add(cnt_p_fx, N_CORR_fx);
}
if (L_sub(dE_fx, /*3*/0x00099999) < 0 && L_sub(r1_fx, /*-0.35*/0xD3333334)>0)
      cnt_s_fx=add(cnt_s_fx, N_CORR_fx);
else cnt_s_fx=0;
if (L_sub(dE_av_fx, 0) < 0)
      cnt_b_fx=add(cnt_b_fx,N_CORR_fx);
else cnt_b_fx=0;
if (sub(cnt_p_fx,40)<0 && sub(cnt_n_fx,140)<0 && sub(cnt_b_fx,110)<0 &&
      sub(cnt_s_fx,130)<0 && L_sub(r1_fx, /*-0.55*/0xB999999A)>0)
      cnt_m_fx=add(cnt_m_fx,N_CORR_fx);
else cnt_m_fx=0;
   if (sub(silence_flag_fx, 0)==0) {
      if (sub(cnt_m_fx, 450)>0) class_sig_fx=2;
      if (sub(cnt_n_fx, 500)==0 || (sub(cnt_m_fx,300)>0 && class_sig_fx==0))
class_sig_fx=1;
      }
   if (L_sub(dE_av_fx, /*20*/ 0x00400000)>0 || L_sub(dE_av_fx, /*-16*/0xFFCCCCCD)<0 ||
      sub(cnt_p_fx,250)>0 || sub(cnt_b_fx,300)>0 ||
      (sub(cnt_n_fx,350)>0 && L_sub(r1_fx, /*0.5*/0x40000000)>0) ||
      (sub(cnt_s_fx,300)>0 && L_sub(r1_fx, /*0.3*/0x26666666)>0) ||
      sub(cnt_s_fx,500)>0) class_sig_fx=0;
   /*-----------------------------------------------------------------*/
   /*              Estimate pitch gain with a low computational load              */
   /*-----------------------------------------------------------------*/
   ptr_fx = buff_mus_fx + MUS_MAX_PIT;
   if ( sub(high_pit_fx, MUS_MAX_PIT) < 0 ) {
    /*search for pitch and R_max*/
    low_pit_fx = high_pit_fx;
    high_pit_fx = add(low_pit_fx, N_CORR_fx);
    if (sub(high_pit_fx, MUS_MAX_PIT)>0) high_pit_fx=MUS_MAX_PIT;
    for (i=low_pit_fx ; i<high_pit_fx ; i++) {
      R_fx = 0x0;
      for (k=0;k<MUS_L_NEW;k++)
        if (R_fx < 0x7FFFFFFF) R_fx = L_mac(R_fx, ptr_fx[k-i], ptr_fx[k]);
      if (L_sub(R_fx, R_max_fx) > 0) {
        R_max_fx=R_fx;
        Pitch_fx=i;
      }
    }
   }
   else {
    /* update Rp and parameters*/
    Rp_old_fx = Rp_fx;
    if (L_sub(R_max_fx, R0_av_fx) >= 0) Rp_fx = 0x7FFFFFFF;
    else {
      nrm = norm_1(R0_av_fx);
      L_temp1 = L_shl(R_max_fx, nrm);
      L_temp2 = L_shl(R0_av_fx, nrm);
      L_Extract(L_temp2, &hi, &lo);
      Rp_fx = Div_32(L_temp1, hi, lo); /* pitch correlation in Q31 */
    }
   R_fx = 0;
   for (k=0;k<MUS_L_NEW;k++) R_fx = L_mac(R_fx, buff_mus_fx[k], buff_mus_fx[k+1]);
   if (L_sub(R_fx, R0_fx) >= 0) r1_fx = 0x7FFFFFFF;
   else {
      nrm = norm_1(R0_fx);
      L_temp1 = L_shl(R_fx, nrm);
      L_temp2 = L_shl(R0_fx, nrm);
      L_Extract(L_temp2, &hi, &lo);
      r1_fx = Div_32(L_temp1, hi, lo); /* tilt in Q31 */
   }
   high_pit_fx = MUS_MIN_PIT;
   R_max_fx = 0x0;
   dE_fx = labs(L_sub(Energy_fx, Energy_old_fx));
   Energy_old_fx=Energy_fx;
   Pitch_old_fx=Pitch_new_fx;
   Pitch_new_fx=Pitch_fx;
   if (Pitch_new_fx==Pitch_old_fx) cnt_pit_fx++;
   else cnt_pit_fx=0;
   /*-----------------------------------------------*/
```

APPENDIX-continued

```
/*   possible music frames                          */
/*----------------------------------------------*/
Cond1_fx = (L_sub(Rp_fx, /*0.4*/0x33333333)>0 ||
        (L_sub(Rp_fx, /*0.32*/0x28F5C28F)>0 && L_sub(Rp_old_fx,
/*0.5*/0x40000000)>0) ||
        (L_sub(Rp_fx, /*0.22*/0x1C28F5C2)>0 && L_sub(Rp_old_fx,
/*0.9*/0x73333333)>0));
Cond2_fx = (sub(cnt_pit_fx,1) > 0);
Cond3_fx = ((sub(class_sig_fx, 1)>=0 && L_sub(r1_fx, /*0.3*/0x26666666)<0) ||
        sub(class_sig_fx,2)==0);
Cond4_fx = (sub(Cond3_fx,1)==0) && (L_sub(Rp_fx, /*0.3*/0x26666666)>0 ||
                    L_sub(Rp_old_fx,/*0.5*/0x40000000)>0);
Cond5_fx = (sub(class_sig_fx, 2)==0) && (L_sub(r1_fx, /*0.5*/0x40000000)<0) &&
      ( (L_sub(Rp_fx,/*0.26*/0x2147AE14)>0) || (L_sub(Rp_old_fx,
/*0.45*/0x3999999A)>0) );
if ( (sub(silence_flag_fx, 0)==0) &&
     (sub(Cond1_fx,1)==0 || sub(Cond2_fx,1)==0 || sub(Cond4_fx,1)==0 ||
sub(Cond5_fx,1)==0)
     ) {
    cnt_mus_fx = add(cnt_mus_fx,1);
    if (sub(cnt_mus_fx, 150)>0) cnt_mus_fx=150;
    cnt2_fx=add(cnt2_fx,1);
}
else {
    if (sub(silence_flag_fx,0)==0) cnt_mus_fx=sub(cnt_mus_fx,8);
    else if (sub(cnt_mus_fx,75)<0 && L_sub(Frm_cnt_fx,64*THRD_fx)>0)
        cnt_mus_fx = sub(cnt_mus_fx,3);
    if (sub(cnt_mus_fx, -100)<0) cnt_mus_fx=-100;
    cnt2_fx=0;
}
/*----------------------------------------------*/
/*    short-term detection                        */
/*----------------------------------------------*/
if ( L_sub(dE_fx, /*7*/0x00166666)<0 && L_sub(Rp_fx,/*0.4*/0x33333333)>0 )
     cnt0_fx=add(cnt0_fx,1);
else cnt0_fx=0;
if (L_sub(Rp_fx, /*0.85*/0x6CCCCCCD)>0) cnt1_fx=add(cnt1_fx,1);
else cnt1_fx=0;
if (sub(cnt_mus_fx,MUS_CNT)<0 && sub(silence_flag_fx,0)==0) {
    if (sub(cnt0_fx,25)>0 || sub(cnt1_fx,20)>0 || sub(cnt2_fx,100)>0)
cnt_mus_fx=MUS_CNT;
    if (sub(cnt0_fx,6)>0 && sub(cnt2_fx,40)>0 && sub(cnt_mus_fx,35)>=0)
cnt_mus_fx=MUS_CNT;
    if (sub(cnt0_fx,9)>0 && sub(cnt2_fx,28)>0 && sub(cnt_mus_fx,40)>=0)
cnt_mus_fx=MUS_CNT;
    if (sub(cnt0_fx,9)>0 && sub(cnt1_fx,9)>0 && sub(cnt_s_fx,200)>0)
cnt_mus_fx=MUS_CNT;
    if (sub(cnt0_fx,16)>0 && sub(cnt1_fx,2)>0 && sub(cnt_mus_fx,20)>0)
cnt_mus_fx=MUS_CNT;
    if (sub(class_sig_fx,2)==0) {
     if (sub(cnt0_fx,9)>0 && sub(cnt2_fx,30)>0 && sub(cnt_b_fx,150)>0)
cnt_mus_fx=MUS_CNT;
     if (L_sub(r1_fx,/*-0.4*/0xCCCCCCCD)<0 && sub(cnt2_fx,48)>0 &&
sub(cnt_b_fx,110)>0) cnt_mus_fx=MUS_CNT;
     }
    if (sub(cnt0_fx,5)>0 && L_sub(r1_fx,/*-0.6*/0xB3333333)<0 &&
     sub(cnt_m_fx,100)>0) cnt_mus_fx=MUS_CNT;
    if (sub(cnt1_fx,4)>0 && L_sub(r1_fx,/*-0.55*/0xB999999A)<0 && sub(cnt_mus_fx,-
10)>0)
     cnt_mus_fx=MUS_CNT;
    if (sub(cnt1_fx,7)>0 && sub(cnt_m_fx,150)>0 && L_sub(dE_fx,/*10*/0x00200000)<0
&&
     L_sub(dE_av_fx, /*-5*/0xFFF00000)<0) cnt_mus_fx=MUS_CNT;
    if (sub(cnt_pit_fx,3)>0 && sub(cnt_n_fx,200)>0) cnt_mus_fx=MUS_CNT;
    if (class_sig_fx==0 && cnt_mus_fx==MUS_CNT) class_sig_fx=1;
}
/*----------------------------------------------*/
/*    long-term detection                         */
/*----------------------------------------------*/
*Music_flag=0;
if (sub(silence_flag_fx,0)==0) {
    if (sub(cnt_mus_fx,MUS_CNT)>=0) mus_flag_fx = 1;
    if (sub(cnt_mus_fx,MUS_CNT/2)<0) mus_flag_fx = 0;
```

APPENDIX-continued

```
    if (mus_flag_fx==1) *Music_flag=1;
  }
 }
 return;
}
#endif
```

What is claimed is:

1. A method of detecting music in a speech signal having a plurality of frames, said method comprising:

obtaining one or more first pitch correlation candidates from a first frame of said plurality of frames;

obtaining one or more second pitch correlation candidates from a second frame of said plurality of frames;

selecting a pitch correlation (R(p) from said one or more first pitch correlation candidates and said one or more second pitch correlation candidates;

defining a music threshold value for said pitch correlation (Rp);

defining a background noise threshold value for said pitch correlation (Rp);

defining an unsure threshold value for said pitch correlation (Rp), wherein said unsure threshold value falls between said music threshold value and said background noise threshold value;

wherein if said pitch correlation (Rp) does not fall between said music threshold value and said background noise threshold value, classifying said speech signal as music if said pitch correlation (Rp) is in closer range of said music threshold value than said unsure threshold value; and classifying said speech signal as background noise if said pitch correlation (Rp) is in closer range of said background noise threshold value than said unsure threshold value;

wherein if said pitch correlation (Rp) falls between said music threshold value and said background noise threshold value, classifying said speech signal as music or background noise based on analyzing a plurality of pitch correlations (Rps) extracted from said plurality of frames.

2. The method of claim 1, said method further comprising if a value of said pitch correlation (Rp) falls between said unsure threshold value and said background noise threshold value, then incrementing a no music frame counter.

3. The method of claim 1, said method further comprising if a value of said pitch correlation (Rp) falls between said unsure threshold value and said music threshold value, then incrementing a music frame counter.

4. The method of claim 1, said method further comprising comparing a no music frame counter and a music frame counter after analyzing a plurality of values of said pitch correlation (Rp) falling between said background noise threshold value and said music threshold value.

5. The method of claim 1 further comprising:

obtaining one or more third pitch correlation candidates from a third frame of said plurality of frames;

obtaining one or more fourth pitch correlation candidates from a fourth frame of said plurality of frames;

obtaining one or more fifth pitch correlation candidates from a fifth frame of said plurality of frames;

obtaining one or more sixth pitch correlation candidates from a sixth frame of said plurality of frames;

obtaining one or more seventh pitch correlation candidates from a seventh frame of said plurality of frames; and obtaining one or more eighth pitch correlation candidates from a eighth frame of said plurality of frames;

wherein said selecting includes selecting said pitch correlation (Rp) from said one or more first pitch correlation candidates, said one or more second pitch correlation candidates, said one or more third pitch correlation candidates, said one or more fourth pitch correlation candidates, said one or more fifth pitch correlation candidates, said one or more sixth pitch correlation candidates, said one or more seventh pitch correlation candidates and said one or more eighth pitch correlation candidates.

6. The method of claim 5, wherein each of said one or more first pitch correlation candidates, said one or more second pitch correlation candidates, said one or more third pitch correlation candidates, said one or more fourth pitch correlation candidates, said one or more fifth pitch correlation candidates, said one or more sixth pitch correlation candidates, said one or more seventh pitch correlation candidates and said one or more eighth pitch correlation candidates consists of four pitch correlation candidates.

7. The method of claim 6 further comprises filtering said speech signal using a one-order low-pass filter prior to said obtaining said one or more first pitch correlation candidates.

8. The method of claim 6 further comprises down sampling said speech signal by four prior to said obtaining said one or more first pitch correlation candidates.

9. A method of detecting music in a speech signal having a plurality of frames, said method comprising:

obtaining one or more first pitch correlation candidates from a first frame of said plurality of frames;

obtaining one or more second pitch correlation candidates from a second frame of said plurality of frames;

selecting a single pitch correlation (Rp) from said one or more first pitch correlation candidates and said one or more second pitch correlation candidates; and distinguishing music from background noise based on analyzing said single pitch correlation (Rp).

10. The method of claim 9 further comprising:

obtaining one or more third pitch correlation candidates from a third frame of said plurality of frames;

obtaining one or more fourth pitch correlation candidates from a fourth frame of said plurality of frames;

obtaining one or more fifth pitch correlation candidates from a fifth frame of said plurality of frames;

obtaining one or more sixth pitch correlation candidates from a sixth frame of said plurality of frames;

obtaining one or more seventh pitch correlation candidates from a seventh frame of said plurality of frames; and obtaining one or more eighth pitch correlation candidates from a eighth frame of said plurality of frames;

wherein said selecting includes selecting said single pitch correlation (Rp) from said one or more first pitch correlation candidates, said one or more second pitch correlation candidates, said one or more third pitch correlation candidates, said one or more fourth pitch correlation candidates, said one or more fifth pitch correlation candidates, said one or more sixth pitch correlation candidates, said one or more seventh pitch correlation candidates and said one or more eighth pitch correlation candidates.

11. The method of claim 10, wherein each of said one or more first pitch correlation candidates, said one or more second pitch correlation candidates, said one or more third pitch correlation candidates, said one or more fourth pitch correlation candidates, said one or more fifth pitch correlation candidates, said one or more sixth pitch correlation candidates, said one or more seventh pitch correlation candidates and said one or more eighth pitch correlation candidates consists of four pitch correlation candidates.

12. The method of claim 11 further comprises filtering said speech signal using a one-order low-pass filter prior to said obtaining said one or more first pitch correlation candidates.

13. The method of claim 11 further comprises down sampling said speech signal by four prior to said obtaining said one or more first pitch correlation candidates.

14. A system for detecting music in a speech signal having a plurality of frames, said system comprising:

a pitch correlation module configured to obtain one or more first pitch correlation candidates from a first frame of said plurality of frames and one or more second pitch correlation candidates from a second frame of said plurality of flames, said pitch correlation module further configured to select a single pitch correlation (Rp) from said one or more first pitch correlation candidates and said one or more second pitch correlation candidates; and a music detection module configured to distinguish music from background noise based on analyzing said single pitch correlation (Rp).

15. The system of claim 14, wherein said pitch correlation module is configured to obtain one or more third pitch correlation candidates from a third frame of said plurality of frames, one or more fourth pitch correlation candidates from a fourth frame of said plurality of frames, one or more fifth pitch correlation candidates from a fifth frame of said plurality of frames, one or more sixth pitch correlation candidates from a sixth frame of said plurality of frames, one or more seventh pitch correlation candidates from a seventh frame of said plurality of frames, and one or more eighth pitch correlation candidates from a eighth frame of said plurality of frames, and wherein said pitch correlation module is further configured to select said single pitch correlation (Rp) from said one or more first pitch correlation candidates, said one or more second pitch correlation candidates, said one or more third pitch correlation candidates, said one or more fourth pitch correlation candidates, said one or more fifth pitch correlation candidates, said one or more sixth pitch correlation candidates, said one or more seventh pitch correlation candidates and said one or more eighth pitch correlation candidates.

16. The system of claim 15, wherein each of said one or more first pitch correlation candidates, said one or more second pitch con-elation candidates, said one or more third pitch correlation candidates, said one or more fourth pitch correlation candidates, said one or more fifth pitch correlation candidates, said one or more sixth pitch correlation candidates, said one or more seventh pitch correlation candidates and said one or more eighth pitch correlation candidates consists of four pitch correlation candidates.

17. The system of claim 16 further comprises a one-order low-pass filter for filtering said speech signal prior to obtaining said one or more first pitch correlation candidates.

18. The system of claim 16 further comprises a down sampler for down sampling said speech signal by four prior to obtaining said one or more first pitch correlation candidates.

* * * * *